US010338518B2

(12) United States Patent
Cavill et al.

(10) Patent No.: US 10,338,518 B2
(45) Date of Patent: Jul. 2, 2019

(54) REDUNDANT ELECTRICAL CONTACT BETWEEN A FASTENER AND A COMPONENT

(71) Applicant: LEXMARK INTERNATIONAL, INC., Lexington, KY (US)

(72) Inventors: Gregory Alan Cavill, Winchester, KY (US); Christopher Elliot Lingle, Lexington, KY (US); Philip John Male, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 15 days.

(21) Appl. No.: 15/223,070

(22) Filed: Jul. 29, 2016

(65) Prior Publication Data

US 2018/0032027 A1 Feb. 1, 2018

(51) Int. Cl.

| | |
|---|---|
| ***G03G 15/08*** | (2006.01) |
| ***G03G 21/16*** | (2006.01) |
| ***G03G 21/18*** | (2006.01) |

(52) U.S. Cl.

CPC ..... *G03G 21/1652* (2013.01); *G03G 15/086* (2013.01); *G03G 15/0865* (2013.01); *G03G 21/1821* (2013.01)

(58) Field of Classification Search

CPC ..... G03G 21/1652; G03G 15/0865

See application file for complete search history.

(56) References Cited

U.S. PATENT DOCUMENTS

| | | | | | |
|---|---|---|---|---|---|
| 2,067,238 | A * | 1/1937 | Johnson | H01G 4/255 | 361/291 |
| 2,089,850 | A * | 8/1937 | Kenney | B60Q 3/30 | 200/535 |
| 2,957,157 | A * | 10/1960 | Carter | H01R 33/02 | 338/316 |
| 3,736,394 | A * | 5/1973 | Rumbaugh | F16B 31/028 | 200/572 |
| 3,739,327 | A * | 6/1973 | Massa | G01S 1/72 | 367/157 |
| 3,824,555 | A * | 7/1974 | Klein | H01R 4/62 | 439/782 |
| 5,508,877 | A * | 4/1996 | Smith | H01T 4/06 | 361/119 |
| 5,828,008 | A * | 10/1998 | Lockwood | H01R 4/26 | 174/138 R |
| 5,863,227 | A * | 1/1999 | Bell, Jr. | H01R 11/12 | 439/883 |

(Continued)

*Primary Examiner* — Victor Verbitsky

(57) ABSTRACT

An assembly according to one example embodiment includes an electrically conductive fastener that includes a head and a shank. The shank extends from an undersurface of the head along a longitudinal axis of the fastener to a distal end of the fastener. A fastening hole is formed by an electrically nonconductive material. At least a portion of the shank of the fastener is installed in the fastening hole. An electrically conductive component is held between the undersurface of the head of the fastener and a surface surrounding an entrance to the fastening hole. An electrically conductive flange extends from the component and contacts an outer portion of the head of the fastener such that an electrical path is formed between the fastener and the component.

25 Claims, 8 Drawing Sheets

(56) References Cited

U.S. PATENT DOCUMENTS 6,033,269 A * 3/2000 Sekido ..... B60R 16/0239 439/796
6,129,492 A * 10/2000 Uno ..... H01R 4/26 411/161
6,297,447 B1 * 10/2001 Burnett ..... H01R 9/0524 174/40 CC
7,862,356 B1 * 1/2011 O'Leary ..... H02G 5/007 174/68.2
2006/0056937 A1 * 3/2006 Babej ..... F16B 37/062 411/181
2006/0160434 A1 * 7/2006 Pettersen ..... F16B 5/0258 439/801
2007/0084371 A1 * 4/2007 Nagler ..... B41F 27/1231 101/415.1
2009/0113844 A1 * 5/2009 Mead ..... H01R 4/2404 52/745.21
2011/0039430 A1 * 2/2011 Aftanas ..... F24J 2/5258 439/92
2011/0074595 A1 * 3/2011 Guo ..... F16P 3/08 340/687
2011/0138585 A1 * 6/2011 Kmita ..... F24J 2/5258 24/522
2014/0219739 A1 * 8/2014 Hirayama ..... F16B 41/002 411/103
2015/0064989 A1 * 3/2015 Hirasawa ..... H01R 4/305 439/781
2015/0263442 A1 * 9/2015 Bakatsias ..... H01R 12/75 439/78
2016/0168877 A1 * 6/2016 Chen ..... G09F 3/0317 70/14

* cited by examiner

REDUNDANT ELECTRICAL CONTACT BETWEEN A FASTENER AND A COMPONENT

CROSS REFERENCES TO RELATED APPLICATIONS

None.

BACKGROUND

1. Field of the Disclosure

The present disclosure relates generally to electrical contacts and more particularly to a redundant electrical contact between a fastener and a component.

2. Description of the Related Art

Various components in electrical and electromechanical systems and devices require an electrical connection for proper operation. For example, various components of an electrophotographic image forming device require an electrical connection. It is desired for components requiring an electrical connection to maintain consistent electrical contact throughout their useful lives in order to permit continued operation. It is desired for the electrical connections to be robust and effective while also minimizing cost.

SUMMARY

An assembly according to one example embodiment includes an electrically conductive fastener that includes a head and a shank. The shank extends from an undersurface of the head along a longitudinal axis of the fastener to a distal end of the fastener. A fastening hole is formed by an electrically nonconductive material. At least a portion of the shank of the fastener is installed in the fastening hole. An electrically conductive component is held between the undersurface of the head of the fastener and a surface surrounding an entrance to the fastening hole. An electrically conductive flange extends from the component and contacts an outer portion of the head of the fastener such that an electrical path is formed between the fastener and the component.

An assembly for an electrophotographic image forming device according to one example embodiment includes a housing and a plate that is electrically conductive. A fastener physically secures the plate to the housing. The fastener is electrically conductive and provides an electrical path to the plate. The fastener passes through a fastening hole in the plate. The fastener includes a head and a shank that extends from the head along a longitudinal axis of the fastener to a distal end of the fastener. An undersurface of the head of the fastener provides a first electrical contact between the fastener and the plate. A flange is electrically conductive and extends from the plate. The flange contacts an outer portion of the head of the fastener providing a second electrical contact between the fastener and the plate.

A toner container for an electrophotographic image forming device according to one example embodiment includes a housing having a reservoir for holding toner. A plate is positioned in the reservoir. The plate is electrically conductive and forms an electrode of a capacitor for measuring a toner level in the reservoir. A fastener physically secures the plate to the housing. The fastener is electrically conductive and provides an electrical path to the plate. The fastener passes through a fastening hole in the plate. The fastener includes a head and a shank that extends from the head along a longitudinal axis of the fastener to a distal end of the fastener. An undersurface of the head of the fastener is positioned to contact the plate when the fastener is fully installed on the housing against the plate. A flange extends from the plate and contacts an outer portion of the head of the fastener. The flange is electrically conductive and formed integrally with the plate.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
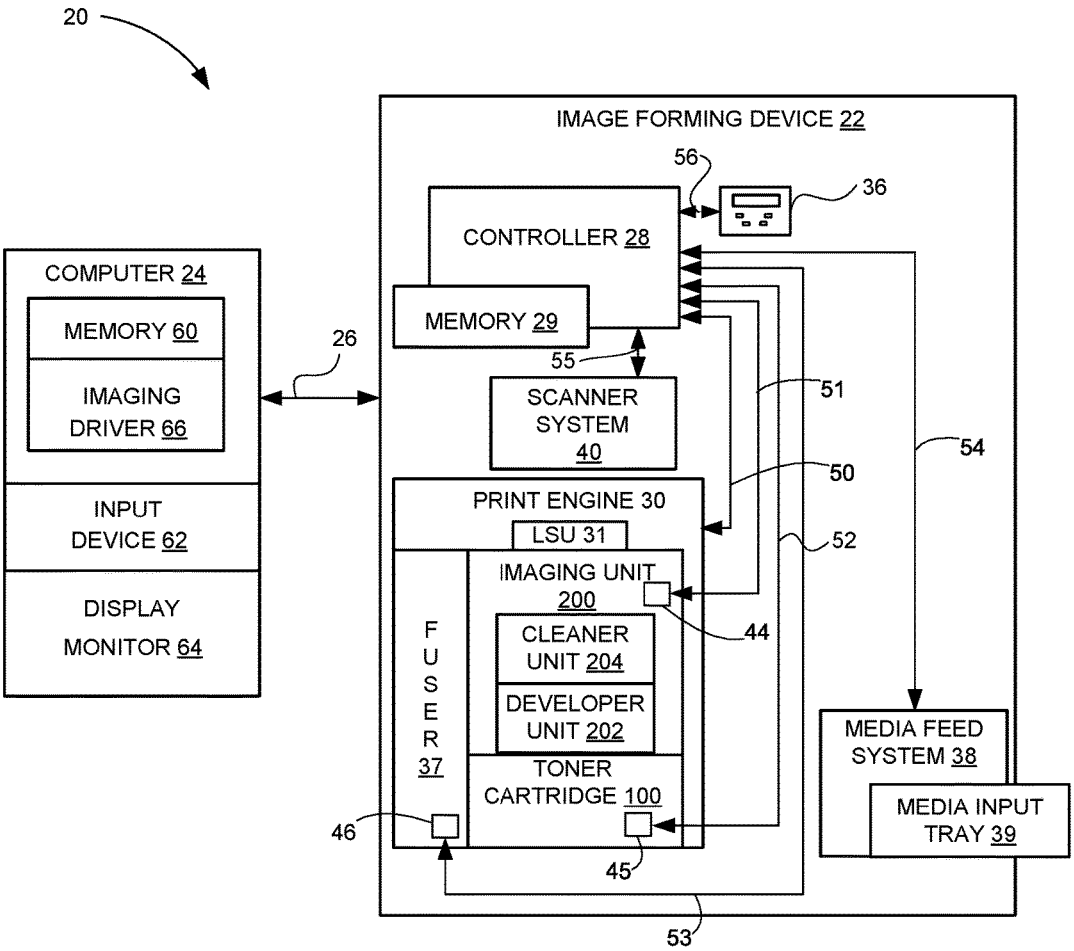
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner sump and a toner development system. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner sump in developer unit 202 to the latent image on the photoconductive drum by the toner development system. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
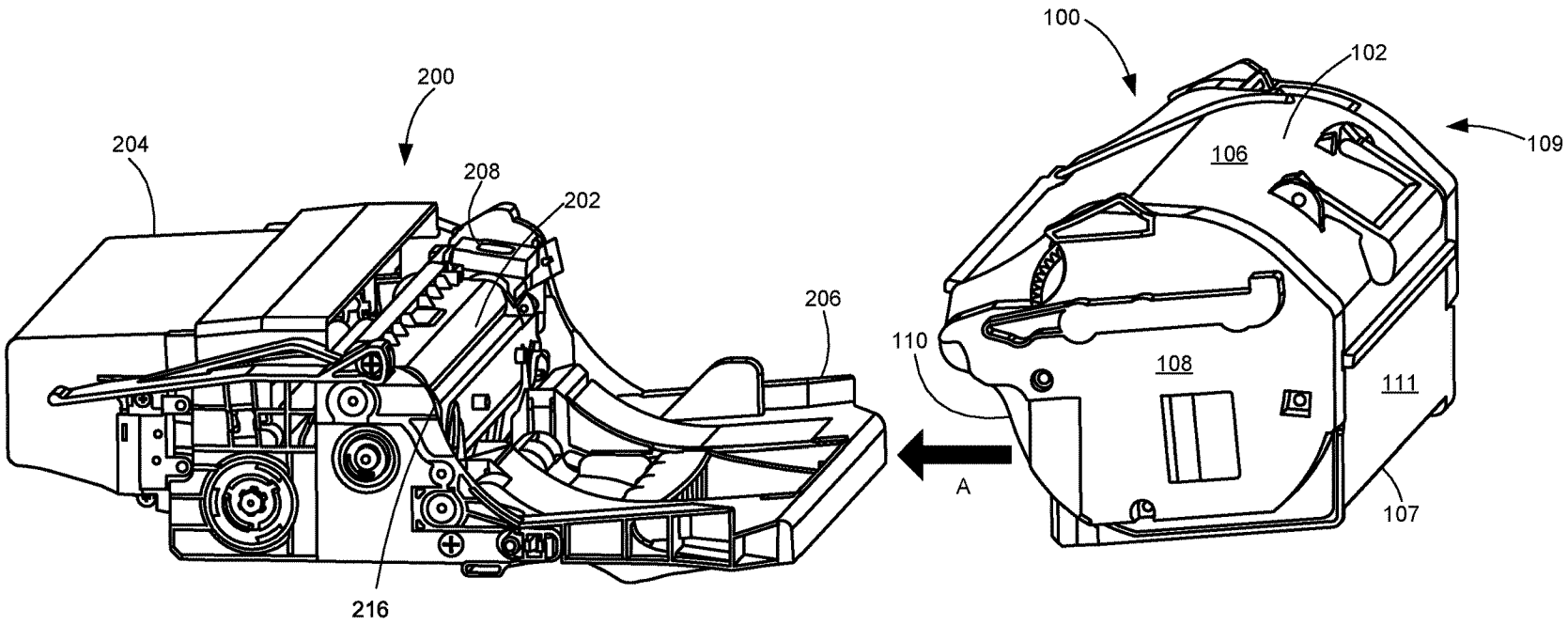
FIG. 2 is a perspective view of a toner cartridge and an imaging unit according to one example embodiment.

Referring now to FIG. 2, toner cartridge 100 and imaging unit 200 are shown according to one example embodiment. Toner cartridge 100 includes a housing 102 having an enclosed reservoir for storing toner. Housing 102 includes a top 106, a bottom 107, first and second sides 108, 109, a front 110 and a rear 111. An outlet port (not shown) in fluid communication with the reservoir of toner cartridge 100 is positioned on front 110 of housing 102 for exiting toner from toner cartridge 100. In the example embodiment illustrated, imaging unit 200 includes a developer unit 202 and a cleaner unit 204 mounted on a common frame 206. Developer unit 202 includes a toner inlet port 208 positioned to receive toner from the outlet port of toner cartridge 100. As discussed above, imaging unit 200 and toner cartridge 100 are each removably installed in image forming device 22. In the embodiment illustrated, imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 2, which also indicates the direction of insertion of imaging unit 200 and toner cartridge 100 into image forming device 22.

Figure 3:
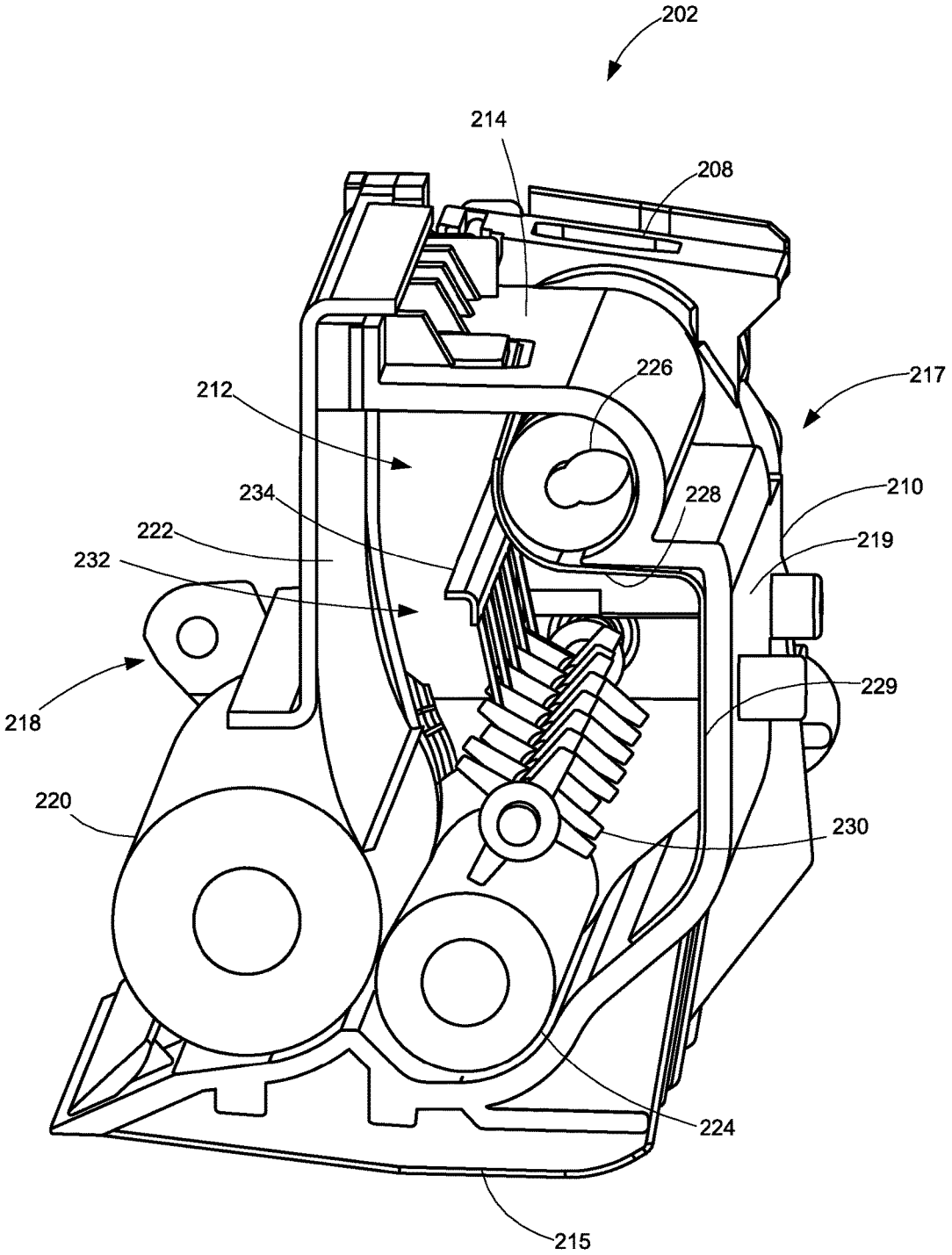
FIG. 3 is a cross-sectional view of a developer unit of the imaging unit shown in FIG. 2 according to one example embodiment.

Referring now to FIG. 3, developer unit 202 is shown according to one example embodiment. Developer unit 202 includes a housing 210 enclosing a sump 212 for storing toner. Housing 210 includes a top 214, a bottom 215, first and second sides 216 (FIG. 2), 217, a front 218 and a rear 219. In the embodiment illustrated, a developer roll 220, a doctor blade 222 and a toner adder roll 224 are positioned within sump 212. Toner adder roll 224 supplies toner from sump 212 to developer roll 220. Doctor blade 222 provides a metered, uniform layer of toner on the surface of developer roll 220. In the embodiment illustrated, a gutter 228 runs along the rear 219 of sump 212 just below inlet port 208. A rotatable auger 226 is positioned in and runs along gutter 228 to distribute toner received by inlet port 208 laterally across sump 212 between sides 216, 217. A rotatable toner agitator 230 is positioned to stir and move toner within sump 212.

Developer unit 202 includes a capacitive toner level sensor 232 for detecting the toner level in sump 212. In some embodiments, developer unit 202 includes a three-plate capacitive toner level sensor 232. The three plates form two parallel capacitors with one plate serving as a common electrode of the two capacitors. In the example embodiment illustrated, an electrically conductive (e.g., metal) sense plate 234 forms the common electrode of the three-plate capacitive toner level sensor 232. Sense plate 234 is positioned in a central region of sump 212, spanning laterally across sump 212. In the example embodiment illustrated, sense plate 234 is positioned near agitator 230 and includes one or more slots formed in sense plate 234 to allow extensions of agitator 230 to pass by sense plate 234 when agitator 230 rotates. Two additional electrodes are positioned along opposite portions of sump 212 relative to sense plate 234 such that sense plate 234 is positioned between the two additional electrodes. In the example embodiment illustrated, gutter 228 is composed of an electrically conductive material and an electrically conductive rear plate 229 extends downward from gutter 228 and laterally across sump 212 along an inner wall of housing 210 at the rear 219 of housing 210. In this embodiment, gutter 228 and rear plate 229 combine to form one of the additional electrodes. Gutter 228 and rear plate 229 may be formed from a single sheet of metal as desired. In the example embodiment illustrated, an electrically conductive doctor blade 222 positioned at the front 218 of housing 210, opposite gutter 228 and rear plate 229 relative to sense plate 234, forms the other additional electrode. The three electrodes form the three plates of capacitive toner level sensor 232. A first capacitor is formed between sense plate 234 and the combination of gutter 228 and rear plate 229. A second capacitor is formed between sense plate 234 and doctor blade 222. It will be appreciated that the plates of capacitive toner level sensor 232 may take many suitable forms and positions and are not limited to the example configuration illustrated.

In the example embodiment illustrated, sense plate 234 is used to sense a capacitance value indicative of the toner level in sump 212 and the other two electrodes are driven by a voltage during a capacitive sensing operation. In some embodiments, gutter 228, rear plate 229 and doctor blade 222 are electrically coupled to each other and driven by a common signal source, such as an AC voltage signal source. In other embodiments, gutter 228 and rear plate 229 are electrically insulated from doctor blade 222 and driven by a separate voltage signal source from doctor blade 222. The first and second capacitors may be characterized by inherent capacitances that vary in response to the amount of toner existing between corresponding electrodes of the two capacitors. As the level of toner within sump 212 rises, toner displaces the air between the respective electrodes of the first and second capacitors. The dielectric constant of toner is generally different from the dielectric constant of air. As a result, changes in the capacitances of the first and second capacitors occur due to a change in the composite dielectric constant of the substance between the respective electrodes of the two capacitors such that changes in the capacitances of the first and second capacitors indicate changes in the toner level in sump 212. Sense plate 234 may be electrically coupled to sensing circuitry (not shown) that receives electrical signals appearing on sense plate 234 and determines the capacitance of the first and second capacitors. The sensing circuitry may be located in processing circuitry 44 of imaging unit 200, controller 28 or a combination thereof. While the example embodiment illustrated includes a three-plate capacitive toner level sensor 232, a two-plate capacitive toner level sensor or a capacitive toner level sensor having more than three plates may be used as desired.

Figure 4:
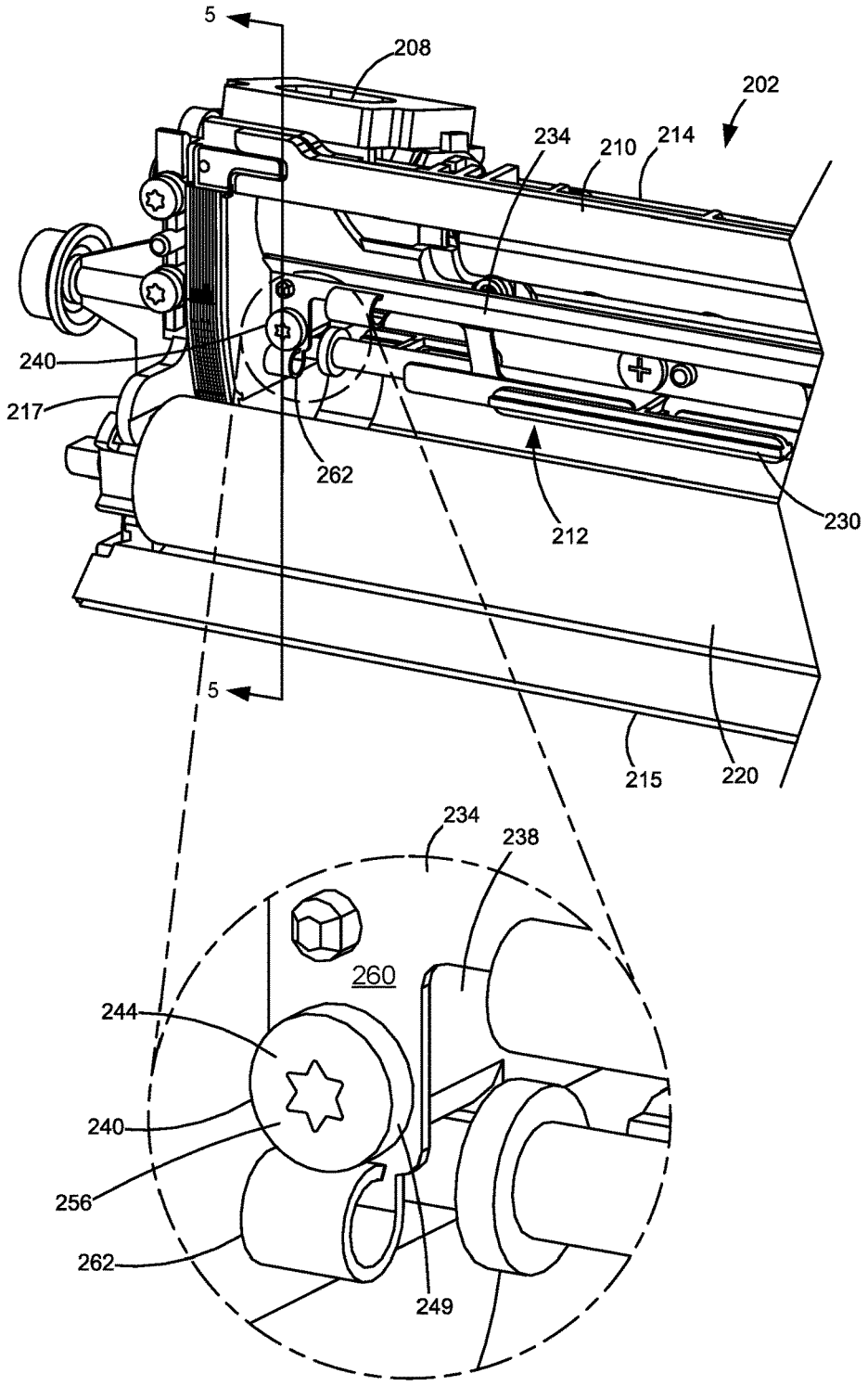
FIG. 4 is a perspective view of the developer unit with a doctor blade of the developer unit omitted showing an electrical contact of a sense plate positioned within a toner sump of the developer unit according to one example embodiment.
Figure 5:
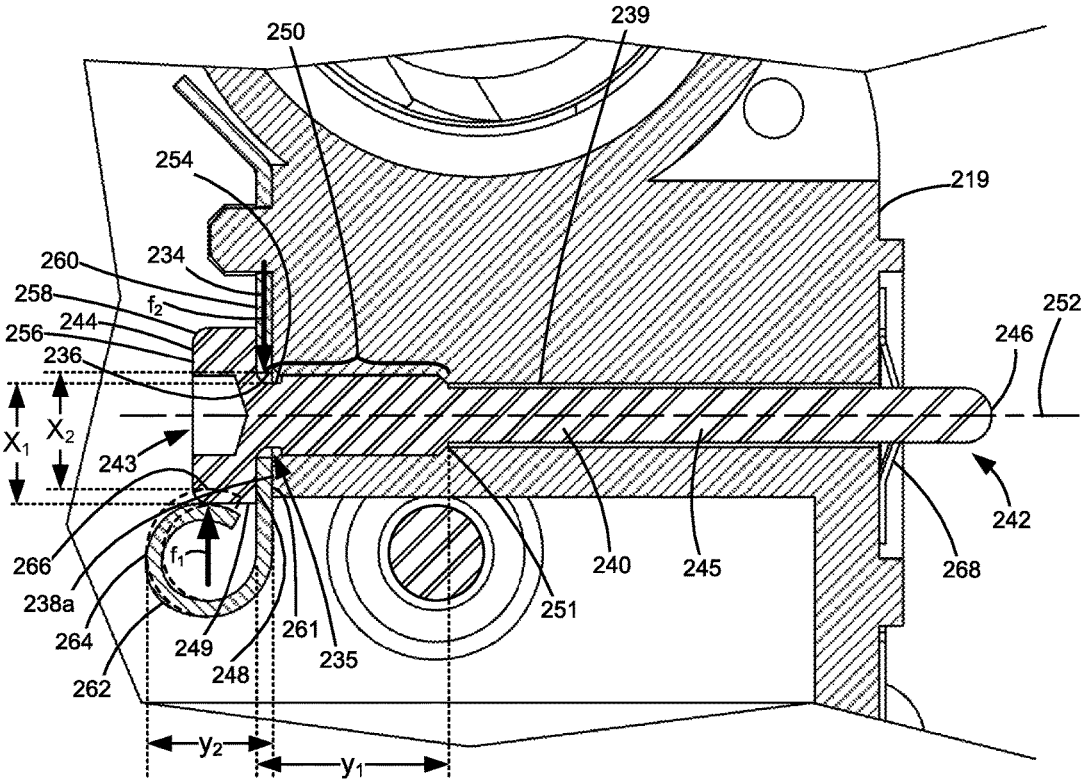
FIG. 5 is a cross-sectional view taken along line 5-5 in FIG. 4 of the engagement between the sense plate and a fastener according to one example embodiment.

FIG. 4 shows a portion of developer unit 202 with doctor blade 222 omitted to more clearly illustrate an electrical contact of sense plate 234 according to one example embodiment. Sense plate 234 is attached to housing 210 by one or more fasteners including a fastener 240 that physically secures a portion of sense plate 234 to housing 210. In the example embodiment illustrated, fastener 240 is a screw; however, any suitable fastener may be used as desired, such as, for example, a bolt, rivet, pin, etc. FIG. 5 shows a cross-sectional view of the engagement between fastener 240 and sense plate 234. With reference to FIGS. 4 and 5, fastener 240 includes a distal end 242 and a proximal end 243. Fastener 240 includes a head 244 at proximal end 243 and a shank 245 that extends from head 244 to a tip 246 of fastener 240 at distal end 242. While the example fastener 240 illustrated includes a head 244 having a circular cross sectional shape, it will be appreciated that head 244 may take any suitable shape, such as, for example, hexagonal, square, etc. In the embodiment illustrated, fastener 240 passes through a fastening hole 235 in sense plate 234 and is secured within a fastening hole 239 of a boss 238 that extends in a cantilevered manner toward sense plate 234 from the rear 219 of housing 210. In the embodiment illustrated, boss 238 is composed of an electrically nonconductive plastic material. Sense plate 234 is secured between an undersurface 248 of head 244 of fastener 240 and an end 238*a* of boss 238. In some embodiments, all or a portion of shank 245 of fastener 240 is threaded. In the example embodiment illustrated, shank 245 of fastener 240 includes a threaded portion 250 positioned proximate to head 244 that aids in securing fastener 240 in boss 238. While the example embodiments illustrated show fastener 240 installed in a fastening hole 239 formed in a boss 238, it will be appreciated that fastener 240 may be installed in any suitable fastening hole.

In addition to physically securing a portion of sense plate 234 to housing 210, fastener 240 also provides an electrical path to sense plate 234 from outside of sump 212. Fastener 240 is composed of an electrically conductive material (e.g., metal). Proximal end 243 of fastener 240 is in contact with sense plate 234 and distal end 242 of fastener 240 is in contact with a corresponding electrical contact 268 on an exterior of the rear 219 of housing 210 facilitating an electrical connection between sense plate 234 and the sensing circuitry of capacitive toner level sensor 232. When fastener 240 is fully driven into boss 238, undersurface 248 of head 244 of fastener 240 physically contacts a surface 260 of sense plate 234 surrounding fastening hole 235 that faces head 244 thereby providing electrical contact between fastener 240 and sense plate 234. Sense plate 234 also includes a flange 262 that extends from sense plate 234 and physically contacts an outer portion (a portion other than undersurface 248) of head 244 of fastener 240. In the embodiment illustrated, flange 262 includes a circular hem shape that curves back toward head 244 of fastener 240; however, flange 262 may take any suitable shape as desired. In the embodiment illustrated, flange 262 is formed integrally with sense plate 234. Flange 262 provides a redundant electrical contact between fastener 240 and sense plate 234 to ensure that consistent electrical contact is maintained between fastener 240 and sense plate 234. For example, flange 262 ensures that sense plate 234 remains in contact with fastener 240 if fastener 240 is not fully driven into boss 238 during assembly or if fastener 240 loosens from boss 238 over time.

In the example embodiment illustrated, flange 262 has an interference contact with an outer side surface 249 of head 244 of fastener 240 such that head 244 deflects flange 262 when fastener 240 is installed in boss 238 and flange 262 remains in contact with head 244 as a result of the resilience of flange 262. FIG. 5 shows the free state of flange 262 in broken line illustrating the interference with head 244 of fastener 240 and the deflected position of flange 262 in solid line illustrating the position of flange 262 relative to head 244 of fastener 240 when fastener 240 is installed in boss 238. In some embodiments, a distance x1 perpendicular to a longitudinal axis 252 of fastener 240 from outer side surface 249 of head 244 of fastener 240 to a radially opposite outer circumferential surface 254 of a portion of shank 245 immediately adjacent to undersurface 248 of head 244 is greater than a distance x2 perpendicular to longitudinal axis 252 from a contact surface 266 of flange 262 when flange 262 is in its free state to a radially opposite circumferential surface 236 of sense plate 234 forming fastening hole 235. This relationship ensures that flange 262 has an interference contact with outer side surface 249 of head 244 regardless of the precise positioning of fastener 240 relative to fastening hole 235 in order to provide consistent contact between flange 262 and head 244. If the outer circumferential surface 254 of the portion of shank 245 immediately adjacent to undersurface 248 of head 244 is threaded, distance x1 refers to the distance from outer side surface 249 of head 244 to a radially opposite root of the threaded portion of shank 245.

Flange 262 applies a force f1 on outer side surface 249 of head 244 that is generally perpendicular to longitudinal axis 252 of fastener 240. The inner surface of boss 238 forming fastening hole 239 and/or circumferential surface 236 of sense plate 234 forming fastening hole 235 apply an opposing force f2 on shank 245 as shown in FIG. 5. Advantageously, these forces f1 and f2 have a limited impact on the torque-driver that is used to install fastener 240 into boss 238 because the forces f1 and f2 are generally perpendicular to the drive direction along longitudinal axis 252 such that the additional force on fastener 240 as a result of the contact from flange 262 does not impede the installation of fastener 240 into boss 238.

Further, in some embodiments, a distance y1 along longitudinal axis 252 from undersurface 248 of head 244 to a distal end 251 of threaded portion 250 of shank 245 is greater than a distance y2 along longitudinal axis 252 from a topmost surface 264 of flange 262 relative to longitudinal axis 252 when flange 262 is in its free state to an undersurface 261 of sense plate 234 that faces away from head 244. As a result, threaded portion 250 of fastener 240 always engages boss 238 before head 244 of fastener 240 contacts flange 262 of sense plate 234 such that the engagement between threaded portion 250 of fastener 240 with boss 238 helps pull fastener 240 into boss 238 to overcome the resistance in the drive direction along longitudinal axis 252 resulting from outer side surface 249 of head 244 of fastener 240 contacting flange 262.

Figure 6:
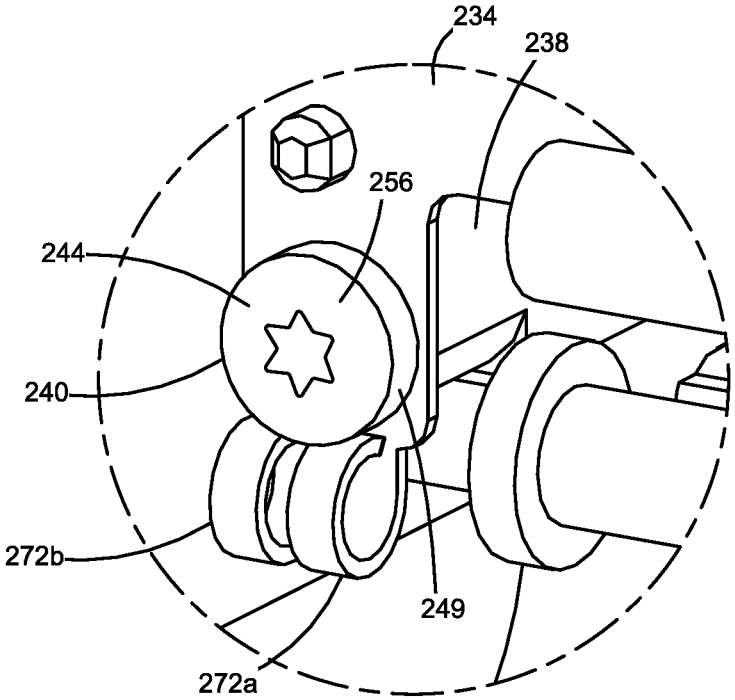
FIG. 6 is a perspective view of the developer unit showing an electrical contact of a sense plate positioned within a toner sump of the developer unit according to another example embodiment.

As discussed above, flange 262 is not limited to the example embodiment illustrated and may take other suitable configurations as desired. For example, FIG. 6 shows sense plate 234 having a redundant electrical contact according to another example embodiment. In this embodiment, a pair of flanges 272*a*, 272*b* extend from sense plate 234 and contact head 244 of fastener 240. In the example embodiment illustrated, flanges 272*a*, 272*b* are formed integrally with sense plate 234. Flanges 272*a*, 272*b* provide an additional redundancy to ensure that consistent electrical contact is maintained between fastener 240 and sense plate 234. Flanges 272*a*, 272*b* may include a pair of distinct extensions from sense plate 234 as illustrated for true redundancy between flanges 272*a*, 272*b* or a single extension from sense plate 234 that splits into two portions prior to contacting head 244. Like flange 262 discussed above, in the example embodiment illustrated, each flange 272*a*, 272*b* has an interference contact with outer side surface 249 of head 244 of fastener 240. In this manner, each flange 272*a*, 272*b* applies a force on outer side surface 249 of head 244 that is generally perpendicular to longitudinal axis 252 of fastener 240 in order to reduce the impact of flanges 272*a*, 272*b* on the torque-driver that is used to install fastener 240 into boss 238. While the example embodiments illustrated show flanges 262, 272*a*, 272*b* in contact with outer side surface 249 of head 244 of fastener, it will be appreciated that flanges 262, 272*a*, 272*b* may contact other portions of head 244 of fastener. For example, in other embodiments, flange 262, 272*a* and/or 272*b* contacts a top surface 256 of head 244 of fastener 240 and/or an edge 258 of head 244 between top surface 256 and outer side surface 249.

Figure 7:
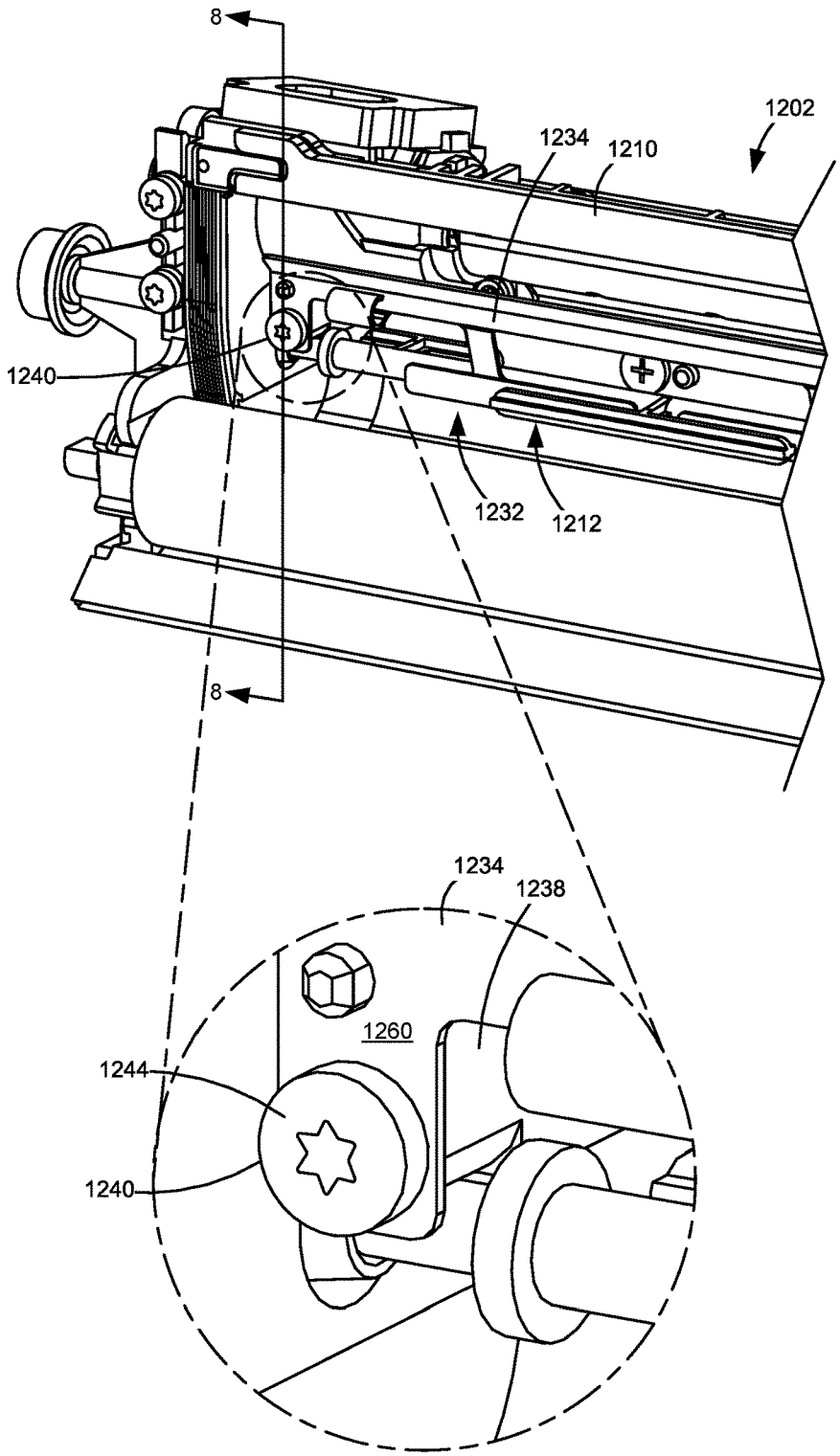
Figure 7 Prior Art
FIG. 7 is a perspective view of a prior art developer unit with a doctor blade of the developer unit omitted showing a prior art electrical contact of a sense plate positioned within a toner sump of the developer unit.
Figure 8:
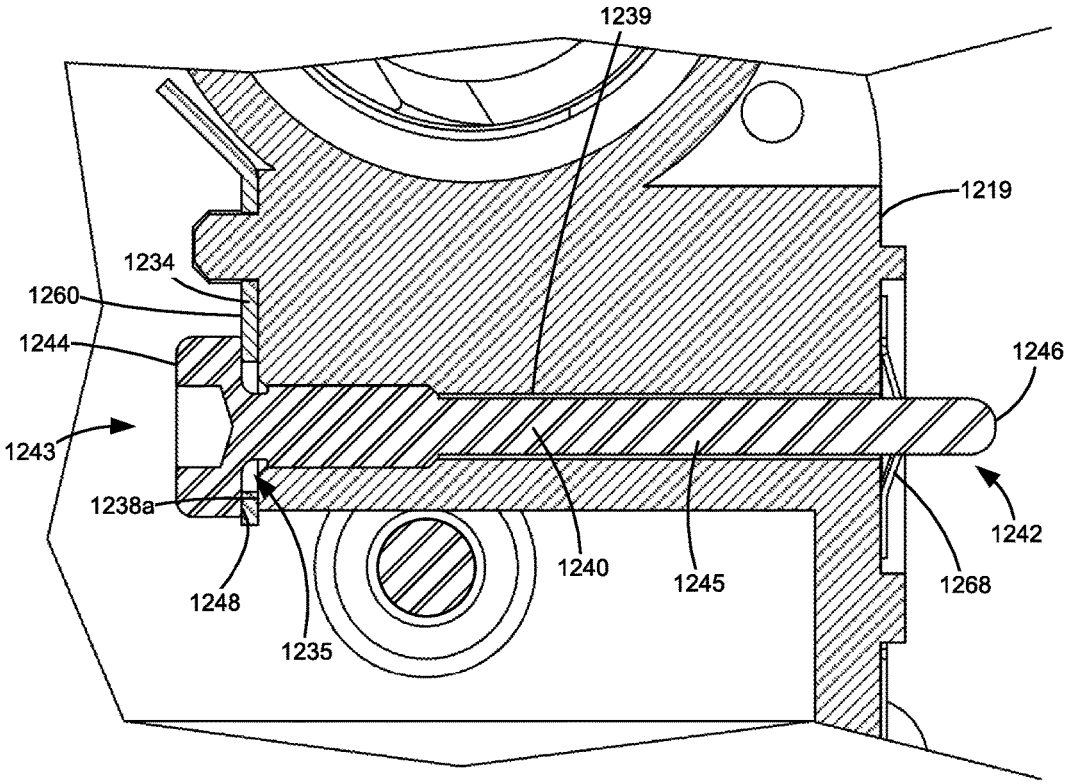
Figure 8 Prior Art
FIG. 8 is a cross-sectional view taken along line 8-8 in FIG. 7 of the engagement between the sense plate and a fastener.

FIGS. 7 and 8 show a portion of a prior art developer unit 1202 with a doctor blade omitted. Developer unit 1202 includes a housing 1210 having a toner sump 1212. Developer unit 1202 also includes a capacitive toner level sensor 1232 having a sense plate 1234. Sense plate 1234 is attached to housing 1210 by a plurality of fasteners including a screw 1240 that physically secures a portion of sense plate 1234 to housing 1210 and provides an electrical path to sense plate 1234 from outside sump 1212. Screw 1240 includes a distal end 1242 and a proximal end 1243. Screw 1240 includes a head 1244 at proximal end 1243 and a shank 1245 that extends from head 1244 to a tip 1246 of screw 1240 at distal end 1242. Screw 1240 passes through a fastening hole 1235 in sense plate 1234 and is secured within a fastening hole 1239 of a boss 1238 that extends in a cantilevered manner toward sense plate 1234 from a rear 1219 of housing 1210. Sense plate 1234 is secured between an undersurface 1248 of head 1244 of screw 1240 and an end 1238*a* of boss 1238.

Screw 1240 is composed of an electrically conductive material. Proximal end 1243 of screw 1240 is in contact with sense plate 1234 and distal end 1242 of screw 1240 is in contact with a corresponding electrical contact 1268 on an exterior of the rear 1219 of housing 1210 facilitating an electrical connection between sense plate 1234 and sensing circuitry of capacitive toner level sensor 1232. When screw 1240 is fully driven into boss 1238, undersurface 1248 of head 1244 of screw 1240 physically contacts a surface 1260 of sense plate 1234 surrounding fastening hole 1235 that faces head 1244 thereby providing electrical contact between screw 1240 and sense plate 1234.

Sense plate 1234 is susceptible to interrupted electrical contact with screw 1240 resulting from assembly errors or material variation. For example, screw 1240 may not maintain consistent contact with sense plate 1234 if screw 1240 is not fully driven into boss 1238 during assembly or if a contaminant is present between screw 1240 and sense plate 1234. Further, even if screw 1240 is fully driven into boss 1238 during the initial assembly of developer unit 1202, screw 1240 may tend to loosen from boss 1238 over time due to, for example, deflection, deformation or other force relaxation of a plastic material forming boss 1238. In contrast, sense plate 234 having a flange (such as flange 262 or flanges 272*a*, 272*b*) that contacts head 244 of fastener 240 as discussed above ensures that consistent electrical contact is maintained between sense plate 234 and fastener 240 as a result of the redundant electrical contact provided by the flange even if fastener 240 is not completely installed or if fastener 240 loosens from boss 238 over time since the flange remains in contact with head 244 of fastener 240 even if undersurface 248 of head 244 loses contact with surface 260 of sense plate 234. Further, where a flange (such as flange 262 or flanges 272*a*, 272*b*) is formed integrally with sense plate 234, the risk of the flange being forgotten or misassembled relative to sense plate 234 that would exist if the flange was a separate component is eliminated. The cost to form the flange integrally with sense plate 234 is also negligible.

Although the example embodiment illustrated includes a redundant electrical contact between a fastener and the common electrode of a three-plate capacitive toner level sensor, it will be appreciated that a flange (such as flange 262 or flanges 272*a*, 272*b*) may be utilized to provide a redundant electrical contact to any electrode of a capacitive toner level sensor. Further, although the example embodiment illustrated includes a capacitive toner level sensor positioned in sump 212 of developer unit 202, it will be appreciated that a capacitive toner level sensor may be positioned in any toner reservoir, such as, for example, the toner reservoir of toner cartridge 100 or a reservoir associated with the waste toner removal system of cleaner unit 204. Further, although the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202, and cleaner unit 204 are housed in one replaceable unit. In another embodiment, the main toner supply for image forming device 22 and developer unit 202 are provided in a first replaceable unit and cleaner unit 204 is provided in a second replaceable unit. Further, although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

Further, although the example embodiment illustrated includes a redundant electrical contact between a fastener and an electrode of a capacitive toner level sensor, it will be appreciated that a flange (such as flange 262 or flanges 272*a*, 272*b*) may be utilized to provide a redundant electrical contact between a fastener and other types of components requiring an electrical connection, including components of an electrophotographic image forming as well as components of other electrical or electromechanical systems and devices.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly, comprising:

an electrically conductive fastener that includes a head and a shank, the shank extends from an undersurface of the head along a longitudinal axis of the fastener to a distal end of the fastener;

a fastening hole formed by an electrically nonconductive material, at least a portion of the shank of the fastener is installed in the fastening hole;

an electrically conductive component held between the undersurface of the head of the fastener and a surface surrounding an entrance to the fastening hole; and an electrically conductive flange that extends from the component and contacts an outer portion of the head of the fastener such that an electrical path is formed between the fastener and the component, wherein the flange is formed integrally with the component.

2. The assembly of claim 1, wherein contact between the flange and the outer portion of the head of the fastener provides a first electrical contact between the fastener and the component and contact between the undersurface of the head of the fastener and the component provides a second electrical contact between the fastener and the component.

3. The assembly of claim 1, wherein the flange has an interference contact with an outer side surface of the head of the fastener.

4. The assembly of claim 3, wherein the shank of the fastener passes through a fastening hole in the component, wherein a first distance perpendicular to the longitudinal axis of the fastener from the outer side surface of the head of the fastener to a radially opposite outer circumferential surface of a portion of the shank immediately adjacent to the undersurface of the head is greater than a second distance perpendicular to the longitudinal axis of the fastener from a contact surface of the flange when the flange is in a free state to a radially opposite circumferential surface of the component forming the fastening hole in the component, wherein the contact surface of the flange is a surface of the flange that contacts the outer side surface of the head of the fastener, wherein the free state of the flange is a position of the flange prior to interference with the head of the fastener.

5. The assembly of claim 3, wherein a first distance along the longitudinal axis of the fastener from the undersurface of the head of the fastener to a distal end of a threaded portion of the shank is greater than a second distance along the longitudinal axis of the fastener from a topmost surface of the flange relative to the longitudinal axis of the flange when the flange is in a free state to an undersurface of the component that faces away from the head of the fastener, wherein the free state of the flange is a position of the flange prior to interference with the head of the fastener.

6. The assembly of claim 1, wherein the flange includes a circular hem shape that curves from the component back toward the head of the fastener.

7. The assembly of claim 1, wherein the flange includes a pair of flanges each extending from the plate and contacting the outer portion of the head of the fastener, each of the pair of flanges is electrically conductive.

8. An assembly for an electrophotographic image forming device, comprising:

a housing;

a plate that is electrically conductive;

a fastener that physically secures the plate to the housing, the fastener is electrically conductive and provides an electrical path to the plate, the fastener passes through a fastening hole in the plate, the fastener includes a head and a shank that extends from the head along a longitudinal axis of the fastener to a distal end of the fastener, an undersurface of the head of the fastener provides a first electrical contact between the fastener and the plate; and a flange that is electrically conductive and extends from the plate, the flange contacts an outer portion of the head of the fastener providing a second electrical contact between the fastener and the plate.

9. The assembly of claim 8, wherein the flange is formed integrally with the plate.

10. The assembly of claim 8, wherein the flange has an interference contact with an outer side surface of the head of the fastener.

11. The assembly of claim 10, wherein a first distance perpendicular to the longitudinal axis of the fastener from the outer side surface of the head of the fastener to a radially opposite outer circumferential surface of a portion of the shank immediately adjacent to the undersurface of the head is greater than a second distance perpendicular to the longitudinal axis of the fastener from a contact surface of the flange when the flange is in a free state to a radially opposite circumferential surface of the plate forming the fastening hole, wherein the contact surface of the flange is a surface of the flange that contacts the outer side surface of the head of the fastener, wherein the free state of the flange is a position of the flange prior to interference with the head of the fastener.

12. The assembly of claim 10, wherein a first distance along the longitudinal axis of the fastener from the undersurface of the head of the fastener to a distal end of a threaded portion of the shank is greater than a second distance along the longitudinal axis of the fastener from a topmost surface of the flange relative to the longitudinal axis of the flange when the flange is in a free state to an undersurface of the plate that faces away from the head of the fastener, wherein the free state of the flange is a position of the flange prior to interference with the head of the fastener.

13. The assembly of claim 8, wherein the flange includes a circular hem shape that curves from the plate back toward the head of the fastener.

14. The assembly of claim 8, wherein the flange includes a pair of flanges each extending from the plate and contacting the outer portion of the head of the fastener, each of the pair of flanges is electrically conductive.

15. The assembly of claim 14, wherein each of the pair of flanges is formed integrally with the plate.

16. A toner container for an electrophotographic image forming device, comprising:

a housing having a reservoir for holding toner;

a plate positioned in the reservoir, the plate is electrically conductive and forms an electrode of a capacitor for measuring a toner level in the reservoir;

a fastener that physically secures the plate to the housing, the fastener is electrically conductive and provides an electrical path to the plate, the fastener passes through a fastening hole in the plate, the fastener includes a head and a shank that extends from the head along a longitudinal axis of the fastener to a distal end of the fastener, an undersurface of the head of the fastener is positioned to contact the plate when the fastener is fully installed on the housing against the plate; and a flange extending from the plate and contacting an outer portion of the head of the fastener, the flange is electrically conductive and formed integrally with the plate.

17. The toner container of claim 16, wherein the flange has an interference contact with an outer side surface of the head of the fastener.

18. The toner container of claim 17, wherein a first distance perpendicular to the longitudinal axis of the fastener from the outer side surface of the head of the fastener to a radially opposite outer circumferential surface of a portion of the shank immediately adjacent to the undersurface of the head is greater than a second distance perpendicular to the longitudinal axis of the fastener from a contact surface of the flange when the flange is in a free state to a radially opposite circumferential surface of the plate forming the fastening hole, wherein the contact surface of the flange is a surface of the flange that contacts the outer side surface of the head of the fastener, wherein the free state of the flange is a position of the flange prior to interference with the head of the fastener.

19. The toner container of claim 17, wherein a first distance along the longitudinal axis of the fastener from the undersurface of the head of the fastener to a distal end of a threaded portion of the shank is greater than a second distance along the longitudinal axis of the fastener from a topmost surface of the flange relative to the longitudinal axis of the flange when the flange is in a free state to an undersurface of the plate that faces away from the head of the fastener, wherein the free state of the flange is a position of the flange prior to interference with the head of the fastener.

20. The toner container of claim 16, wherein the flange includes a circular hem shape that curves from the plate back toward the head of the fastener.

21. The toner container of claim 16, wherein the flange includes a pair of flanges each extending from the plate and contacting the outer portion of the head of the fastener, each of the pair of flanges is electrically conductive and formed integrally with the plate.

22. An assembly, comprising:

an electrically conductive fastener that includes a head and a shank, the shank extends from an undersurface of the head along a longitudinal axis of the fastener to a distal end of the fastener;

a fastening hole formed by an electrically nonconductive material, at least a portion of the shank of the fastener is installed in the fastening hole;

an electrically conductive component held between the undersurface of the head of the fastener and a surface surrounding an entrance to the fastening hole; and an electrically conductive flange that extends from the component and contacts an outer portion of the head of the fastener such that an electrical path is formed between the fastener and the component, wherein the flange has an interference contact with an outer side surface of the head of the fastener, wherein the shank of the fastener passes through a fastening hole in the component, wherein a first distance perpendicular to the longitudinal axis of the fastener from the outer side surface of the head of the fastener to a radially opposite outer circumferential surface of a portion of the shank immediately adjacent to the undersurface of the head is greater than a second distance perpendicular to the longitudinal axis of the fastener from a contact surface of the flange when the flange is in a free state to a radially opposite circumferential surface of the component forming the fastening hole in the component, wherein the contact surface of the flange is a surface of the flange that contacts the outer side surface of the head of the fastener, wherein the free state of the flange is a position of the flange prior to interference with the head of the fastener.

23. An assembly, comprising:

an electrically conductive fastener that includes a head and a shank, the shank extends from an undersurface of the head along a longitudinal axis of the fastener to a distal end of the fastener;

a fastening hole formed by an electrically nonconductive material, at least a portion of the shank of the fastener is installed in the fastening hole;

an electrically conductive component held between the undersurface of the head of the fastener and a surface surrounding an entrance to the fastening hole; and an electrically conductive flange that extends from the component and contacts an outer portion of the head of the fastener such that an electrical path is formed between the fastener and the component, wherein the flange includes a circular hem shape that curves from the component back toward the head of the fastener.

24. An assembly, comprising:

an electrically conductive fastener that includes a head and a shank, the shank extends from an undersurface of the head along a longitudinal axis of the fastener to a distal end of the fastener;

a fastening hole formed by an electrically nonconductive material, at least a portion of the shank of the fastener is installed in the fastening hole;

an electrically conductive component held between the undersurface of the head of the fastener and a surface surrounding an entrance to the fastening hole; and an electrically conductive flange that extends from the component and contacts an outer portion of the head of the fastener such that an electrical path is formed between the fastener and the component, wherein the flange includes a pair of flanges each extending from the plate and contacting the outer portion of the head of the fastener, each of the pair of flanges is electrically conductive.

25. The assembly of claim 24, wherein each of the pair of flanges is formed integrally with the component.

* * * * *